US012146116B2

(12) United States Patent
Suzuki et al.

(10) Patent No.: US 12,146,116 B2
(45) Date of Patent: Nov. 19, 2024

(54) LUBRICATING OIL COMPOSITION

(71) Applicant: SHELL OIL COMPANY, Houston, TX (US)

(72) Inventors: Kengo Suzuki, Kanagawa (JP); Kunitoshi Abe, Tokyo (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 18/252,092

(22) PCT Filed: Nov. 30, 2021

(86) PCT No.: PCT/EP2021/083577
§ 371 (c)(1),
(2) Date: May 8, 2023

(87) PCT Pub. No.: WO2022/122476
PCT Pub. Date: Jun. 16, 2022

(65) Prior Publication Data

US 2024/0010943 A1 Jan. 11, 2024

(30) Foreign Application Priority Data

Dec. 8, 2020 (JP) ..... 2020-203745

(51) Int. Cl.
*C10M 145/30* (2006.01)
*C10M 107/02* (2006.01)
(Continued)

(52) U.S. Cl.
CPC ..... *C10M 145/30* (2013.01); *C10M 107/02* (2013.01); *C10M 129/70* (2013.01);
(Continued)

(58) Field of Classification Search
CPC ..... C10M 145/30; C10M 107/02; C10M 129/70; C10M 145/32; C10M 169/04;
(Continued)

(56) References Cited

U.S. PATENT DOCUMENTS 5,377,899 A 1/1995 Hashimoto
5,485,895 A 1/1996 Peterson et al.
(Continued)

FOREIGN PATENT DOCUMENTS

JP 2015010138 A 1/2015
JP 2015081287 A 4/2015
WO 9611244 A1 4/1996

OTHER PUBLICATIONS

International Search Report and Written Opinion Received for PCT Patent Application No. PCT/EP2021/083577, Mailed on Mar. 3, 2022, 11 Pages.
(Continued)

*Primary Examiner* — Prem C Singh
*Assistant Examiner* — Francis C Campanell
(74) *Attorney, Agent, or Firm* — SHELL USA, INC.

(57) ABSTRACT

The present invention provides a lubricating oil composition comprising: (A) a lubricant base oil including at least one type selected from mineral oil, PAO, and GTL (gas-to-liquid) base oils; (B) a compound having a structure obtained by independently subjecting propylene oxide to addition polymerization with an alcohol or a structure obtained by subjecting a combination of propylene oxide with ethylene oxide and/or butylene oxide to addition polymerization with an alcohol, and being configured so that polyalkylene glycol (PAG) with an oxygen/carbon weight ratio of 0.35 or more and less than 0.45 and/or one or both terminal hydroxyl groups in the polyalkylene glycol (PAG) are blocked; and (C) a fatty acid ester having an oxygen/carbon weight ratio of 0.05 to 0.35.

4 Claims, 3 Drawing Sheets

(51) Int. Cl.

| | |
|---|---|
| ***C10M 129/70*** | (2006.01) |
| ***C10M 145/32*** | (2006.01) |
| ***C10M 169/04*** | (2006.01) |
| *C10N 20/02* | (2006.01) |
| *C10N 30/00* | (2006.01) |
| *C10N 30/02* | (2006.01) |
| *C10N 40/25* | (2006.01) |

(52) U.S. Cl.
CPC ..... *C10M 145/32* (2013.01); *C10M 169/04* (2013.01); *C10M 2205/173* (2013.01); *C10M 2207/281* (2013.01); *C10M 2209/105* (2013.01); *C10M 2209/106* (2013.01); *C10N 2020/02* (2013.01); *C10N 2030/02* (2013.01); *C10N 2030/54* (2020.05); *C10N 2040/25* (2013.01)

(58) Field of Classification Search
CPC ..... C10M 2205/173; C10M 2207/281; C10M 2209/105; C10M 2209/106; C10M 2203/1006; C10M 2205/0285; C10M 2207/28; C10M 2207/283; C10M 2209/104; C10M 2209/108; C10M 2209/109; C10N 2030/54; C10N 2030/08
USPC ..... 508/579
See application file for complete search history.

(56) References Cited

U.S. PATENT DOCUMENTS

| | | | | |
|---|---|---|---|---|
| 8,742,150 | B2 * | 6/2014 | Potula | C07C 67/08 554/219 |
| 9,550,956 | B2 | 1/2017 | Kamata et al. | |
| 9,850,447 | B2 | 12/2017 | Greaves et al. | |
| 11,130,926 | B2 | 9/2021 | Kamei et al. | |
| 2011/0282084 | A1 * | 11/2011 | Potula | C11C 3/00 554/219 |
| 2015/0119303 | A1 * | 4/2015 | Guerin | C10M 161/00 508/304 |

OTHER PUBLICATIONS

Office Action Received for Japanese Application No. 2019116587, Mailed on Aug. 27, 2024, 11 Pages(5 Pages of English Translation and 6 Pages of Official Copy).

* cited by examiner

LUBRICATING OIL COMPOSITION

CROSS REFERENCE TO RELATED APPLICATIONS

This is a National stage application of International Application No. PCT/EP2021/083577, filed 30 Nov. 2021, which claims priority of Japan Application No. 2020-203745, filed 8 Dec. 2020 which is incorporated herein by reference in its entirety.

FIELD OF THE INVENTION

The invention relates to a novel lubricating oil composition that can realize excellent fuel economy.

BACKGROUND OF THE INVENTION

The viscosity of lubricating oil usually decreases as the temperature increases. As a result, the viscosity is generally high at a low temperature, and is generally low at a high temperature. The type of lubricating oil that is used also depends on the usage environment (specifically, the temperature). Among lubricating oils used in both low-temperature environments and high-temperature environments, a low-viscosity lubricating oil might lead to the loss of an oil film at high temperatures due to an extremely low viscosity. Conversely, a high-viscosity lubricating oil might lead to an increase in stirring loss or seizure and wear caused by a pump failure at low temperatures due to an extremely high viscosity.

At the start of activation (during the transition from a stopped state to an operating state, that is, a low-temperature state), the viscosity has to be low. This is because if the viscosity is high at the start of activation, an initial activating force is needed for the transition from a stopped state to an operating state. However, once the machine starts operating, the viscosity hardly matters. When the machine continues operating, it generates heat and the temperature increases (for example, about 100° C.). When a high temperature is reached, a loss of oil film may occur due to the viscosity of the oil being too low.

As mentioned above, it is difficult for a single type of lubricating oil to maintain the required viscosity over a wide range of temperature conditions. Therefore, WO96011244 A1 has disclosed a lubricating oil that can function at low temperatures as well as high temperatures, by combining a low-viscosity lubricating oil with high-viscosity lubricating oil to utilize the properties of the low-viscosity lubricating oil at low temperatures and to utilize the properties of rising viscosity when the high-viscosity lubricating oil is mixed with the low-viscosity lubricating oil at high temperatures.

However, the lubricating oil composition disclosed in WO96011244 A1 cannot always provide sufficient fuel economy. For this reason, it is an object of the present invention to provide a novel lubricating oil composition that can provide excellent fuel economy.

The separation temperature of the composition was studied in the prior art document mentioned above. However, the present inventors discovered that simply controlling the separation temperature of the composition is not enough to improve fuel economy, and that control of the separation rate of the composition is also important. More specifically, they discovered that a quick separation of the high-viscosity component from the low-viscosity component and quick return to the lubricating state provided by the low viscosity component when the composition falls below the separation temperature is important for improving fuel economy.

From this standpoint, the present inventors discovered that they could solve the problem stated above by using a certain base oil and additives as components in a lubricating oil composition, and the present invention is a product of this discovery. In other words, the present invention is as follows.

SUMMARY OF THE INVENTION

The present invention is a lubricating oil composition comprising:

(A) a lubricant base oil including at least one type selected from mineral oil, PAO, and GTL (gas-to-liquid) base oils;

(B) a compound having a structure obtained by independently subjecting propylene oxide to addition polymerization with an alcohol or a structure obtained by subjecting a combination of propylene oxide with ethylene oxide and/or butylene oxide to addition polymerization with an alcohol, and being configured so that polyalkylene glycol (PAG) with an oxygen/carbon weight ratio of 0.35 or more and less than 0.45 and/or one or both terminal hydroxyl groups in the polyalkylene glycol (PAG) are blocked with a substituent having a molecular weight of 200 or less composed of at least one selected from C, N, S and H; and (C) a fatty acid ester having an oxygen/carbon weight ratio of 0.05 to 0.35. Preferably, the 40° C. kinematic viscosity of the fatty acid ester is at least 16 $mm^2/s$.

The present invention is able to provide a novel lubricating oil composition that can realize excellent fuel economy.

DETAILED DESCRIPTION OF THE INVENTION

Figure 1:
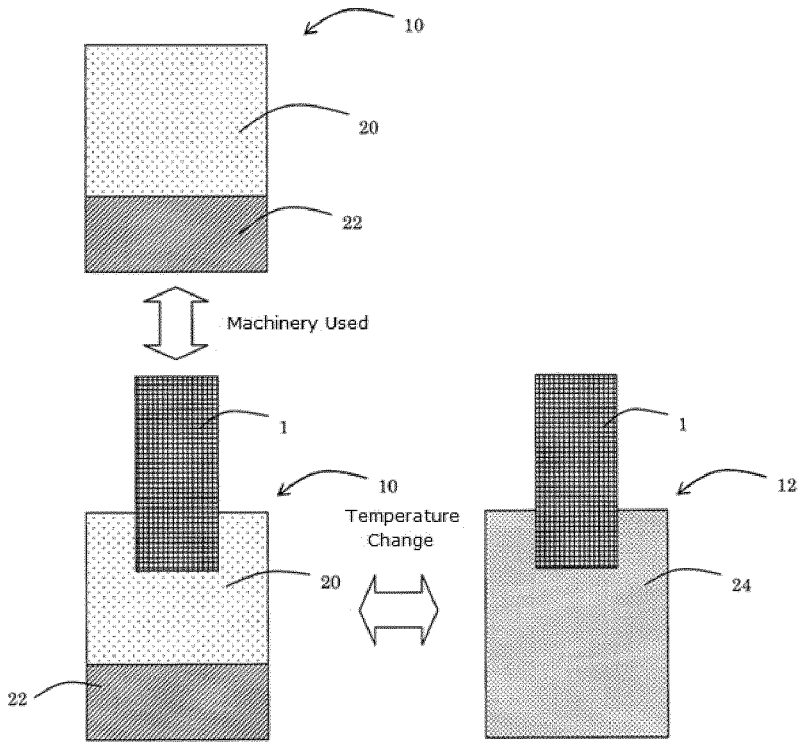
FIG. 1 is a schematic diagram showing the two-layer system of the lubricating oil composition (one example).

The components, physical characteristics/properties, manufacturing method, and applications for lubricating oil compositions of the present invention will now be described.

In the following description, when a separate upper limit value and lower limit value are provided for a given numerical range, it should be assumed that these values are included within the numerical range. Also, "from numerical value A to numerical value B" means "numerical value A or more and numerical value B or less." The expressions "or more" and "or less" when used to describe a numerical range can also be read as "greater than" and "less than."

In the present invention, kinematic viscosity refers to a value measured in accordance with JIS K2283:2000.

The oxygen/carbon weight ratio in the present invention represents the ratio of the weight of oxygen relative to the weight of carbon among the components, and this value mainly affects physical characteristics such as the density and the polarity of the compound. For example, the polarity is affected by the type of functional group, which can be an ether group, ester group, hydroxyl group, or carboxyl group.

Because oxygen atoms have a high electronegativity, the polarity tends to be higher when the oxygen/carbon weight ratio is higher. As for the density, because oxygen is heavier than carbon, compounds having a large oxygen/carbon weight ratio tend to have a higher density. The oxygen/carbon weight ratio can be measured in accordance with JPI-5S-65 (Petroleum Products: Carbon, Hydrogen and Nitrogen Testing Methods) and JPI-5S-68 (Petroleum Products: Oxygen Testing Methods).

The lubricating oil composition is obtained by mixing together a low-viscosity component as component (A), a high-viscosity component as component (B), and a control component as component (C). In other words, the lubricating oil composition contains at least (A) a low-viscosity component, (B) a high-viscosity component, and (C) a control component. The lubricating oil composition may contain other components. Each component will now be described.

The low-viscosity component (A) is a lubricating oil base oil containing at least one base oil selected from among mineral oil, PAO, and GTL (gas to liquid) base oils.

There are no particular restrictions on the mineral oils used in the present invention. However, preferred examples include paraffin-based or naphthene-based mineral oils obtained by applying one or more refining means, such as solvent degassing, solvent extraction, hydrocracking, solvent dewaxing, catalytic dewaxing, hydrorefining, sulfuric acid washing and clay treatment, to a lubricating oil fraction obtained by atmospheric distillation and vacuum distillation of crude oil.

A PAO (poly-α-olefin) is an α-olefin homopolymer or copolymer. An α-olefin is a compound with a C—C double bond at the terminal, and specific examples include butene, butadiene, hexene, cyclohexene, methylcyclohexene, octene, nonene, decene, dodecene, tetradecene, hexadecene, octadecene, and eicosene. These can be used alone or in combinations of two or more. These compounds may have any isomeric structure as long as they have a C—C double bond at the terminal, and may have a branched structure or a linear structure. These structural isomers and positional isomers with double bonds can be used in combinations of two or more. Among these olefins, a linear olefin having from 6 to 30 carbon atoms is preferred because the flash point is low when the number of carbon atoms is five or less, and the viscosity is high and the olefin impractical when the number of carbon atoms is 31 or higher.

A gas-to-liquid (GTL) is a base oil synthesized using the Fischer-Tropsch method for converting natural gas into liquid fuel. Compared to a mineral base oil refined from crude oil, a GTL base oil has a very low sulfur and aromatic content and a very high paraffin component ratio. As a result, it has excellent oxidative stability and very low evaporation loss, and is ideal for use as a base oil.

These low-viscosity components (A) can be used alone or in combinations of two or more.

The kinematic viscosity at 40° C. of the low-viscosity component (A) is preferably 10 $mm^2/s$ or more and less than 100 $mm^2/s$, more preferably from 15 to 80 $mm^2/s$, and even more preferably from 25 to 70 $mm^2/s$. The kinematic viscosity at 100° C. of the low-viscosity component (A) is preferably from 1 to 50 $mm^2/s$, more preferably from 3 to 2/s, and even more preferably greater than 4 $mm^2/s$ and less than 20 $mm^2/s$. The density at 20° C. of the low-viscosity component (A) is preferably from 0.700 to 1.000 $g/cm^3$, more preferably from 0.750 to 0.950 $g/cm^3$, and even more preferably from 0.800 to 0.880 $g/cm^3$.

The amount of low-viscosity component (A) included relative to the overall weight (100% by weight) of the lubricating oil composition can be 20% by weight or more, preferably 25% by weight or more, and more preferably 30% by weight or more.

The high-viscosity component (B) is a polyalkylene glycol (PAG) obtained by subjecting an alkylene oxide to addition polymerization with an alcohol. The polyalkylene glycol (PAG) may be a compound in which a terminal hydroxyl group has been modified (blocked) with a well-known compound as long as the basic properties can be maintained. More specifically, the high-viscosity component (B) may be a compound in which one or both terminal hydroxyl groups in the polyalkylene glycol (PAG) have been blocked with a substituent ("blocking group" below) having a molecular weight of 200 or less composed of at least one element selected from C, N, O, S and H. Here, the blocking group can be any well-known substituent and may have an ester bond or an ether bond. An alkyl group (for example, a linear or branched group having from 1 to 10 carbon atoms) is preferred, and a methyl group or an ethyl group is more preferred. A compound in which a terminal hydroxyl group is blocked by a blocking group may be referred to below as a polyalkylene glycol derivative.

Examples of these polyalkylene glycols and polyalkylene glycol derivatives include those represented by the following formulas.

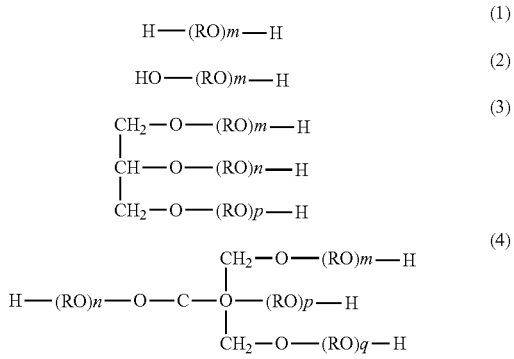

In these formulas, each R independently represents a linear or branched hydrocarbon group having from 2 to 10 carbon atoms, preferably from 2 to 8 carbon atoms, and more preferably from 2 to 6 carbon atoms, and m is an integer from 2 to 500, preferably from 2 to 400, and more preferably from 2 to 300. Note that none of the Rs has to be a single alkylene, and may be a combination of different alkylenes. In a specific example, $(RO)_m$ above can be $(R_1O)$ m1 $(R_2O)$ m2, when $(RO)_m$ above is a block copolymer with two types of alkylene oxides.

Component (B) is preferably a compound represented by formulas (2) to (4).

The polyalkylene glycol may be composed of one or more alkylene oxides. Ethylene oxide, propylene oxide, or butylene oxide may be used alone, or a combination of two or more of these may be used (such as ethylene oxide/propylene oxide). The polyalkylene glycol preferably has a structure obtained by independently subjecting propylene oxide to addition polymerization with an alcohol or a structure obtained by subjecting a combination of propylene oxide with ethylene oxide and/or butylene oxide to addition polymerization with an alcohol.

These high-viscosity components (B) can be used alone or in combinations of two or more.

The oxygen/carbon weight ratio in the high-viscosity component (B) is preferably 0.35 or more, 0.36 or more, or more, or 0.38 or more, and preferably less than less than 0.42, or less than 0.40. More specifically, the oxygen/carbon weight ratio in the high-viscosity component (B) is preferably 0.35 or more and less than 0.45, and more preferably 0.38 or more and less than 0.45. When the high-viscosity component (B) is a compound in which one or both terminal hydroxyl groups in polyalkylene glycol (PAG) have been blocked with a blocking group, the terminal blocking groups are not to be included in the calculation of the oxygen/carbon weight ratio.

The kinematic viscosity at 40° C. of the high-viscosity component (B) is preferably 100 $mm^2/s$ or more, more preferably 150 $mm^2/s$ or more, and even more preferably 200 $mm^2/s$ or more. The kinematic viscosity at 100° C. of the high-viscosity component (B) is preferably from 20 to $mm^2/s$, more preferably from 30 to 3,000 $mm^2/s$, and even more preferably from 40 to 1,000 $mm^2/s$. The density at 20° C. of the high-viscosity component (B) is preferably more than 0.950 and 1.050 $g/cm^3$ or less, more preferably from 0.960 to 1.030 $g/cm^3$, and even more preferably from 0.970 to 1.010 $g/cm^3$.

The amount of high-viscosity component (B) included relative to the overall weight (100% by weight) of the lubricating oil composition can be from 3 to 50% by weight, preferably from 5 to 40% by weight, and more preferably from 7 to 30% by weight.

When such a high-viscosity component is combined with a low-viscosity component, it does not substantially mix with the low-viscosity component at low temperatures, but does mix with the low-viscosity component at high temperatures.

Control component (C) is a fatty acid ester. In the fatty acid ester, the number of ester bonds per molecule is preferably 1 to 3, and more preferably 1 to 2.

The fatty acid ester is an ester of a monovalent or polyvalent carboxylic acid and a monohydric or polyhydric alcohol. It may be saturated or unsaturated, and may be linear or branched.

Specific examples of fatty acid esters include:

(1) monoesters, such as an ester of a monovalent carboxylic acid (for example, formic acid, acetic acid, propionic acid, butyric acid, valeric acid, caproic acid, enanthic acid, capric acid, pelargonic acid, capric acid, undecyl acid, lauric acid, tridecyl acid, hexadecyl acid, heptadecylic acid, stearic acid, oleic acid, linoleic acid, or linolenic acid) and a monohydric alcohol (for example, a linear or branched monohydric alcohol such as methanol, ethanol, propanol, butanol, pentanol, hexanol, heptanol, octanol, nonanol, or decanol);

(2) diesters, such as an ester of a dicarboxylic acid (for example, a linear or branched dicarboxylic acid such as malonic acid, succinic acid, glutaric acid, adipic acid, pimelic acid, suberic acid, azelaic acid, or sebacic acid) and a monohydric alcohol (for example, one of the monohydric alcohols mentioned above), and an ester of a monovalent carboxylic acid (for example, one of the monovalent carboxylic acids mentioned above) and a divalent alcohol (for example, a linear or branched dihydric alcohol such as ethylene glycol, propylene glycol, butylene glycol, neopentylene glycol, or hexylene glycol); and (3) triesters, such as an ester of a monovalent carboxylic acid (for example, one of the monovalent carboxylic acids mentioned above) and a trihydric alcohol (for example, glycerin, butanetriol, and trimethylolpropane), and an ester of a trivalent carboxylic acid (for example, citric acid or isocitric acid) and a monohydric alcohol (such as one of the monohydric alcohols mentioned above).

Examples of fatty acid esters with four or more ester bonds per molecule include esters of tetravalent carboxylic acids or higher (for example, ethanetetracarboxylic acid, propanetetracarboxylic acid, and butanetetracarboxylic acid) and monohydric alcohols (such as the monohydric alcohols mentioned above), and esters of monovalent carboxylic acids (for example, the monovalent carboxylic acids mentioned above) and tetravalent alcohols or higher (for example, pentaerythritol, dipentaerythritol, sorbitol, and derivatives thereof).

In the case of an ester of a polyhydric alcohol and a carboxylic acid or an ester of a polyvalent carboxylic acid and an alcohol, some or all of the hydroxyl groups and carbonyl groups in the molecule may have reacted.

These control compounds (C) may be used alone or in combinations of two or more.

The oxygen/carbon weight ratio of the control compound (C) is preferably 0.045 or more, 0.055 or more, or more, or 0.075 or more, and preferably 0.35 or less, 0.33 or less, 0.31 or less, or 0.30 or less. More specifically, the oxygen/carbon weight ratio of the control compound (C) is preferably 0.055 to 0.35, and more preferably 0.075 to 0.35.

The kinematic viscosity at 40° C. of the control component (C) is preferably from 15 to 80 $mm^2/s$, more preferably from 16 to 60 $mm^2/s$, and even more preferably from 17 to 50 $mm^2/s$. The kinematic viscosity at 100° C. of the control component (C) is preferably from 1 to 30 $mm^2/s$, more preferably from 1.5 to 20 $mm^2/s$, and even more preferably from 2 to 10 $mm^2/s$. The density at 20° C. of the control component (C) is preferably from 0.800 to 1.000 $g/cm^3$, more preferably from 0.825 to 0.980 $g/cm^3$, and even more preferably from 0.850 to 0.960 $g/cm^3$.

The amount of control component (C) included relative to the overall weight (100% by weight) of the lubricating oil composition can be from 1 to 65% by weight, preferably from 2 to 60% by weight, and more preferably from 3 to 55% by weight.

Depending on the intended use, the lubricating oil composition may contain well-known components in addition to the components described above. These components include additives such as pour point depressants, defoamers, detergents, dispersants, wear resistant agents, metal deactivators, and antioxidants.

These components can compose, for example, 1% by weight or more, 3% by weight or more, or 5% by weight or more, and 25% by weight or less, 20% by weight or less, or 15% by weight or less of the total weight of the lubricating oil composition.

Usage Example

A usage example will now be explained with reference to FIG. 1 in which the lubricating oil composition is used when machinery is started up. FIG. 1 (upper figure) shows the lubricating oil composition in the two-layer state 10, or the low temperature state. Because the low-viscosity component 20 is a low-density lubricating oil, it forms the upper layer. Because the high-viscosity component 22 is a high-density lubricating oil, it forms the lower layer. FIG. 1 (lower left figure) shows the machine 1 to be lubricated during use, where the machine is immersed in the upper layer of the lubricating oil composition. At start-up (low temperature), the low-viscosity upper layer primarily contributes to the lubrication, and the high-viscosity lower layer 22 hardly contributes at all. At low temperatures, the low-viscosity lubricating oil provides sufficient performance (viscosity) for lubrication, so the low-viscosity component used alone does not impair lubrication performance. FIG. 1 (lower right figure) shows the single layer state 12 in which the temperature has risen as a result of continued use. Here, the low-viscosity component 20 and the high-viscosity component 22 mix together as the temperature rises to form a uniform lubricating oil composition 24. When the high-viscosity component 22 is mixed in after the low-viscosity component is used alone, the high-viscosity component 22 compensates for the decrease in viscosity due to the rise in temperature of the low-viscosity component 20, and problems such as loss of an oil film due to the rise in temperature do not occur. By forming a uniform one-layer system at a temperature equal to or higher than the separation temperature, the high-viscosity component compensates for the decrease in the viscosity of the low-viscosity component.

By keeping the separation temperature at a given temperature in the present invention, so that the low-viscosity lubricating oil, which usually forms the upper layer, contributes to lubrication of the machine at low temperatures, and a mixture of the high-viscosity lubricating oil and the low-viscosity lubricating oil contributes to lubrication at high temperatures, a very excellent separation rate can be obtained.

The lubricating oil composition can be produced using any well-known method, and there are no particular restrictions on mixing order for each component as long as each component is mixed properly. The additives may be added in the form of an additive package in which a plurality of additives have been mixed together.

The separation temperature of the lubricating oil composition is preferably in the range from 40 to 100° C. The separation temperature is the temperature at which the transition occurs in the lubricating oil composition between a one-layer state and a two-layer state, and is the temperature at which cloudiness (precipitation) is observed when the lubricating oil composition is heated in the two-layer state to form the one-layer state and is then cooled. The separation temperature can be measured using the following method.

Measurement is performed using a Corning PC-420D heater.

Figure 2:
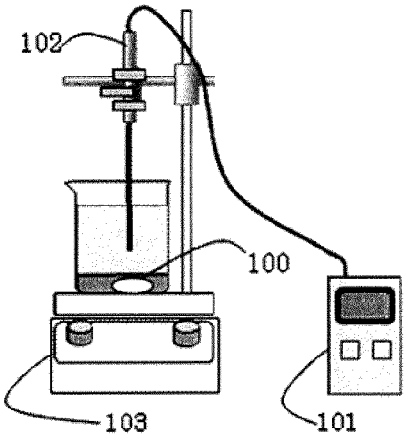
FIG. 2 shows one example of measuring the separation temperature of a lubricating oil composition.

(1) 100 g of the sample is collected in a 300 ml beaker and a stirrer 100 is inserted.
(2) The laboratory equipment shown in FIG. 2 is assembled, and a thermocouple 102 connected to a thermometer 101 is inserted into the oil to measure the oil temperature.
(3) The stirring speed of the hot stirrer 103 is set to 600 rpm.
(4) The plate temperature is set to 120° C. and heat is applied until the oil temperature reaches 105° C.
(5) When the oil temperature reaches 105° C., the heating and stirring is stopped and the sample is cooled to room temperature.
(6) The condition of the sample in the beaker is observed during cooling.
(7) When the sample in the beaker becomes cloudy (precipitates become visible), the oil temperature is recorded and used as the separation temperature. The separation temperature is determined visually with reference to the aniline point measurement (JIS K2256).

The lubricating oil composition preferably has a separation rate A that is greater than 10%/min, and a separation rate A that is greater than 10%/min and a separation rate B that is greater than 30%/min. Separation rate A and separation rate B are measured using the following method.

This measure is performed using an SV-10 tuning fork vibration viscometer.

Figure 3:
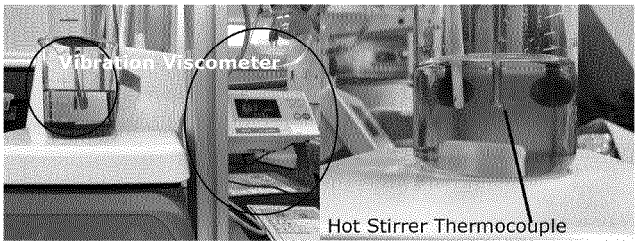
FIG. 3 is a photograph of the laboratory equipment used to measure the separation temperature of a lubricating oil composition.

(1) 100 g of the sample is collected in a 300 ml beaker and a stirrer 100 is inserted.
(2) The laboratory equipment shown in FIG. 3 is assembled, and the terminals of the vibration viscometer are placed in the oil.
(3) The stirring speed of the hot stirrer 103 is set to 600 rpm.
(4) The plate temperature is set to 120° C. and heat is applied until the oil temperature reaches 105° C.
(5) When the oil temperature reaches 105° C., the heating and stirring is stopped and the sample is cooled to room temperature.
(6) The viscosity and hot water temperature are measured using the vibration viscometer 80 minutes and 300 minutes after the oil temperature reaches 100° C. In order to calculate the kinematic viscosity, the sample is stirred and heated to 70° C. to form a single layer, and the density at 70° C. is measured. The density conversion at each temperature is performed in accordance with JIS2249.
(7) The residual amount of high-viscosity base oil in the low-viscosity base oil is calculated by comparing the kinematic viscosity of the sample when high-viscosity base oil is removed to the kinematic viscosity, and the separation rate is calculated using Equation 1). The methods for estimating the kinematic viscosity and the mixing ratio in Annex 1 of JIS K2283 were used to calculate the residual amount.

Separation Rate={[(Amount of High-Viscosity Base Oil−Residual Amount)/Amount of High-Viscosity Base Oil]×100}/Time (Minutes)

(8) Once the oil temperature has reached 100° C., the separation rate after 80 minutes is used as separation rate A, and the separation rate after 300 minutes is used as separation rate B.

The kinematic viscosity at 40° C. of the lubricating oil composition is preferably from 10 to 100 $mm^2/s$, more preferably from 15 to 80 $mm^2/s$, and even more preferably from 20 to 60 $mm^2/s$. Here, the kinematic viscosity at 40° C. is the kinematic viscosity of the upper layer at 40° C. where the lubricating oil composition has separated into two layers.

The kinematic viscosity at 100° C. of the lubricating oil composition is preferably from 1 to 30 $mm^2/s$, more preferably from 3 to 20 $mm^2/s$, and even more preferably from 5 to 15 $mm^2/s$. Here, the kinematic viscosity at 100° C. is the kinematic viscosity of the one-layer state at 100° C. where the upper and lower layers of the lubricating oil composition have mixed together.

The viscosity index (VI) of the lubricating oil composition is preferably 50 or more, more preferably 150 or more, and even more preferably 200 or more. The viscosity index is a convenient index indicating the degree of change in the viscosity of the lubricating oil due to a temperature change. A high viscosity index means the change in viscosity with respect to the temperature change is small. The viscosity index here can be calculated using the viscosity index calculating method specified in JIS K 2283 based on the kinematic viscosity at 40° C. of the upper layer where the lubricating oil composition has separated into two layers and the kinematic viscosity at 100° C. where the upper and lower layers of the lubricating oil composition have mixed together to form a single layer state.

There are no particular restrictions on the applications for the lubricating oil composition, and it can be used as a lubricating oil in various types of machines. For example, it can be used to lubricate rotating components and sliding components in various types of vehicles and industrial machines. More specifically, it can be used as a lubricating oil in a low temperature (for example −40° C.) to high temperature (for example, 120° C.) range in automotive engines (diesel engines, gasoline engines, etc.), transmissions (gear devices, CVT, AT, MT, DCT, Diff, etc.), industrial machinery (construction machinery, agricultural machinery, industrial machinery, gear equipment, etc.), bearings (turbines, spindles, machine tools, etc.), hydraulic systems (hydraulic cylinders, door checks, etc.), and compressors (compressors, pumps, etc.).

EXAMPLES

The present invention will now be described in greater detail with reference to examples and comparative examples. However, the present invention is not limited in any way by these examples.

Lubricating Compositions

The raw materials were mixed together as shown in Tables 1 to 3 to produce the lubricating oil compositions in the examples and comparative examples.

Evaluation

The kinematic viscosities (40° C., 100° C.), separation temperatures, and separation rates of the lubricating oil compositions were evaluated. The results of each evaluation are shown in Tables 1 to 3. The evaluation method used for each evaluated item is described above.

TABLE 1

| Category | Structure | Ester Bonds/ Molecule | KV40 | KV100 | O/C | Density at 20° C. |
|---|---|---|---|---|---|---|
| Base Oil (Low Vis Base Oil) | Hydrocarbon (GTL Base Oil) | — | 44.6 | 7.64 | — | 0.8251 |
| PAG (High Vis Base Oil) | Polypropylene Glycol | — | 329.5 | 53.59 | 0.44 | 1.003 |
| | Polypropylene Glycol | — | 616 | 96.7 | 0.44 | 1.003 |
| | Polypropylene Glycol | — | 35273 | 27738 | 0.44 | 0.9981 |
| | Polyoxytetramethylene-Polyoxypropylene Glycol | — | 2606.8 | 401 | 0.38 | 0.9952 |
| | Polypropylene Glycol | — | 680 | 77 | 0.34 | 0.972 |
| Ester | Stearic Acid and 2-Hexyldecyl Ester (Full Ester) | 1 | 17.72 | 4.4 | 0.08 | 0.855 |
| | Oleic Acid and Neopentyl Glycol Ester (Full Ester) | 2 | 26.24 | 6.159 | 0.14 | 0.9016 |
| | Oleic Acid and Trimethylolpropane Ester (Full Ester) | 3 | 48 | 9.7 | 0.14 | 0.9152 |
| | (Octanoic Acid + Decanoic Acid) and Trimethylolpropane (Full Ester) | 3 | 20 | 4.5 | 0.25 | 0.9424 |
| | Oleic Acid Trimethylolpropyl Pentaerythritol Ester (Full Ester) | 4 | 71.2 | 12.7 | 0.15 | 0.9248 |
| Additive PKG | Additive Package | — | — | — | — | — |

Total

Ideal calculation Kv40 (upper layer low viscosity component when separated into two liquids)

KV100 when treated as two liquids

VI when treated as two liquids

Separation Rate

Sep Rate A: 300 min after start of cooling (22° C.) (separation rate %/hour 300 min × 100)

Sep Rate B: 80 min after start of cooling (30° C.) (separation rate %/hour 80 min × 100)

(Evaluation) A > 10 and B > 30: ⊙; A > 10: ○; 10 ≥ A > 7: Δ; 7 ≥ A > 0: X

TABLE 2

| Category | Structure | Ex. 1 | Ex. 2 | Ex. 3 | Ex. 4 | Ex. 5 |
|---|---|---|---|---|---|---|
| Base Oil (Low Vis Base Oil) | Hydrocarbon (GTL Base Oil) | 13.20 | 37.00 | 35.75 | 31.50 | 39.50 |
| PAG (High Vis Base Oil) | Polypropylene Glycol | | | | | 19.00 |
| | Polypropylene Glycol | | | 14.75 | 14.00 | |
| | Polypropylene Glycol | | | | | |
| | Polyoxytetramethylene-Polyoxypropylene Glycol | 28.30 | 18.50 | | | |
| | Polypropylene Glycol | | | | | |
| Ester | Stearic Acid and 2-Hexyldecyl Ester (Full Ester) | 52 | | | | |
| | Oleic Acid and Neopentyl Glycol Ester (Full Ester) | | 38.00 | | | |

TABLE 2-continued

| Category | Structure | Ex. 1 | Ex. 2 | Ex. 3 | Ex. 4 | Ex. 5 |
|---|---|---|---|---|---|---|
| | Oleic Acid and Trimethylolpropane Ester (Full Ester) | | | 43.00 | 48.00 | 35.00 |
| | (Octanoic Acid + Decanoic Acid) and Trimethylolpropane (Full Ester) | | | | | |
| | Oleic Acid Trimethylolpropyl Pentaerythritol Ester (Full Ester) | | | | | |
| Additive PKG | Additive Package | 6.5 | 6.50 | 6.50 | 6.50 | 6.50 |
| | Total | 100.0 | 100.0 | 100.0 | 100.0 | 100.0 |
| | Ideal calculation Kv40 | 23.03 | 35.57 | 47.74 | 47.92 | 47.56 |
| | KV100 when treated as two liquids | 11.3 | 11.3 | 11.3 | 11.3 | 11.3 |
| | VI when treated as two liquids | 519 | 330 | 240 | 239 | 241 |
| | Separation Rate | 64 | 58 | 60 | 50 | 60 |
| | Sep Rate A: 300 min after start of cooling (22° C.) | 14 | 16.7 | 10.7 | 15 | 11 |
| | Sep Rate B: 80 min after start of cooling (30° C.) | 38.75 | 38.3 | 0 | 9 | 0.7 |
| | (Evaluation) A > 10 and B > 30: ⊙; A > 10: ○; 10 ≥ A > 7: Δ; 7 ≥ A > 0: X | ⊙ | ⊙ | ○ | ○ | ○ |

TABLE 3

| Category | Structure | Ex. 6 | Ex. 7 | Ex. 8 | Ex. 9 | Ex. 10 | C. Ex. 1 |
|---|---|---|---|---|---|---|---|
| Low Vis Base Oil | Hydrocarbon (GTL Base Oil) | 33.50 | 47.40 | 46.30 | 38.70 | 47.80 | 39 |
| PAG (High vis Base Oil) | Polypropylene Glycol | | | | | | |
| | Polypropylene Glycol | | | | | | |
| | Polypropylene Glycol | 7.00 | | | | | |
| | Polyoxytetramethylene-Polyoxypropylene Glycol | | 11.60 | 11.70 | 22.80 | 7.70 | |
| | Polypropylene Glycol | | | | | | 16.5 |
| Ester | Stearic Acid and 2-Hexyldecyl Ester (Full Ester) | | | | | | |
| | Oleic Acid and Neopentyl Glycol Ester (Full Ester) | | | | | | |
| | Oleic Acid and Trimethylolpropane Ester (Full Ester) | 53.00 | 34.50 | 35.50 | | | 38 |
| | (Octanoic Acid + Decanoic Acid) and Trimethylolpropane (Full Ester) | | | | 32.00 | | |
| | Oleic Acid Trimethylolpropyl Pentaerythritol Ester (Full Ester) | | | | | 38.00 | |
| Additive PKG | Additive Package | 6.50 | 6.50 | 6.50 | 6.50 | 6.50 | 6.5 |
| | Total | 100.0 | 100.0 | 100.0 | 100.0 | 100.0 | 100 |
| | Ideal calculation Kv40 | 47.74 | 47.29 | 47.32 | 32.3 | 53.36 | 50.07 |
| | KV100 when treated as two liquids | 11.5 | 11.3 | 11.3 | 11.3 | 11.3 | 11.3 |
| | VI when treated as two liquids | 240 | 240 | 242 | 365 | 212 | — |
| | Separation Rate | 68 | 45 | 61 | 64 | 57 | * |
| | A: 300 min after start of cooling (22° C.) | 19.3 | 21 | 10.7 | 12.43 | 7.7 | 0 |
| | B: 80 min after start of cooling (30° C.) | 13.8 | 11.78 | 3.8 | 20.9 | 0 | 0 |
| | (Evaluation) A > 10 and B > 30: ⊙; A > 10: ○; 10 ≥ A > 7: Δ; 7 ≥ A > 0: X | ○ | ○ | ○ | ○ | Δ | X |

In Comparative Example 1, the separation rate could not be measured as it dissolved below room temperature.

Because the lubricating oil compositions in these examples have a predetermined separation temperature and have an excellent separation rate, excellent lubrication performance is exhibited in response to temperature changes, and this results in excellent fuel economy.

We claim:

1. A lubricating oil composition comprising:

(A) a lubricant base oil including at least one type selected from mineral oil, PAO, and GTL (gas-to-liquid) base oils;

(B) a high viscosity component in an amount of from 7 to 30% by weight relative to the overall weight of the lubricating oil composition, wherein the high viscosity component has a kinematic viscosity at 100° C. of from 40 to 1000 $mm^2/s$ and is a polyalkylene glycol (PAG) having a structure obtained by independently subjecting propylene oxide to addition polymerization with an alcohol or a structure obtained by subjecting a combination of propylene oxide with ethylene oxide and/or butylene oxide to addition polymerization with an alcohol, and wherein the PAG has an oxygen/carbon weight ratio of 0.35 or more and less than 0.45, and (C) a fatty acid ester having an oxygen/carbon weight ratio of 0.05 to 0.35.

2. The lubricating oil composition according to claim 1, wherein the 40° C. kinematic viscosity of the fatty acid ester is at least 16 $mm^2/s$.

3. The lubricating oil composition according to claim 1, wherein the polyalkylene glycol has one or more terminal hydroxyl groups, wherein one or more than one of the one or more terminal hydroxyl groups are blocked with a blocking group having a molecular weight of 200 or less and composed of at least one selected from C, N, O, S and H, and wherein the blocking groups are not included in the calculation of the oxygen/carbon weight ratio.

4. The lubricating oil composition according to claim 1, wherein the lubricant base oil has a kinematic viscosity at 100° C. of greater than 4 $mm^2/s$ and less than 20 $mm^2/s$.

* * * * *